US010306349B2

(12) United States Patent
Zhao et al.

(10) Patent No.: US 10,306,349 B2
(45) Date of Patent: May 28, 2019

(54) EARPHONE

(71) Applicant: GOERTEK INC., Weifang, Shandong (CN)

(72) Inventors: Yanpeng Zhao, Shandong (CN); Qigao Chen, Shandong (CN); Tonghui Guo, Shandong (CN); Ping Xie, Shandong (CN)

( * ) Notice: Subject to any disclaimer, the term of this patent is extended or adjusted under 35 U.S.C. 154(b) by 0 days.

(21) Appl. No.: 15/737,597

(22) PCT Filed: Jul. 19, 2016

(86) PCT No.: PCT/CN2016/090426
§ 371 (c)(1),
(2) Date: Dec. 18, 2017

(87) PCT Pub. No.: WO2017/012529
PCT Pub. Date: Jan. 26, 2017

(65) Prior Publication Data

US 2018/0160214 A1 Jun. 7, 2018

(30) Foreign Application Priority Data

Jul. 22, 2015 (CN) ..... 2015 2 0536049 U

(51) Int. Cl.
*H04R 1/10* (2006.01)
*H04R 1/02* (2006.01)
(Continued)

(52) U.S. Cl.
CPC ..... *H04R 1/1041* (2013.01); *H04R 1/1016* (2013.01); *H04R 1/1058* (2013.01);
(Continued)

(58) Field of Classification Search
CPC .... H04R 1/10; H04R 2205/022; H04R 1/105; H04R 5/0335; H04R 2201/10
(Continued)

(56) References Cited

U.S. PATENT DOCUMENTS 8,565,467 B1 * 10/2013 Tseng ..... H04R 1/1016 381/379
8,755,555 B2 * 6/2014 Dougherty ..... H04R 1/1066 381/379
(Continued)

FOREIGN PATENT DOCUMENTS

CN 104023292 A 9/2014
CN 203933915 U 11/2014
(Continued)

OTHER PUBLICATIONS

International Search Report of the Chinese Patent Office (ISA) dated Oct. 10, 2016.

*Primary Examiner* — Suhan Ni
(74) *Attorney, Agent, or Firm* — Patshegen IP LLC; Moshe Pinchas

(57) ABSTRACT

An earphone, comprising a rear housing, a front housing, and a loudspeaker unit which divides a cavity formed by the rear housing and the front housing into a front and rear acoustic cavities; wherein the earphone further comprises a sound adjusting element; the front housing is provided with a sound outlet hole and mode posts, and the sound adjusting element is provided with a sound adjusting hole corresponding to the sound outlet hole and a mode adjustment groove corresponding to the mode posts; when the sound adjusting element rotates, the mode adjustment groove may be limited by different mode posts, thus adjusting the volume of the front acoustic cavity and the area of a sound hole for the front acoustic cavity. Use of the above-described invention enables the middle and high frequency responses of the earphone to be adjusted and enables a single earphone to provide different sound characteristics.

16 Claims, 6 Drawing Sheets

(51) Int. Cl.
*H04R 9/02* (2006.01)
*H04R 9/06* (2006.01)

(52) U.S. Cl.
CPC ..... *H04R 1/023* (2013.01); *H04R 9/025* (2013.01); *H04R 9/06* (2013.01)

(58) Field of Classification Search
USPC ..... 381/370–374, 379–384
See application file for complete search history.

(56) References Cited

U.S. PATENT DOCUMENTS

| | | | | |
|---|---|---|---|---|
| 9,031,275 | B2 * | 5/2015 | Brodsgaard ..... | H04R 1/105 381/374 |
| 2012/0114160 | A1 * | 5/2012 | Lin ..... | H04R 1/1091 381/380 |

FOREIGN PATENT DOCUMENTS

| | | | |
|---|---|---|---|
| CN | 204465800 | U | 7/2015 |
| CN | 204859501 | U | 12/2015 |
| EP | 2822293 | A2 | 1/2015 |

* cited by examiner

EARPHONE

TECHNICAL FIELD

The present invention relates to the acoustoelectric technical field, and more particularly, relates to an earphone.

BACKGROUND ART

As widespread use of portable electronic products such as high quality smartphones, Pads and the like, requirements on earphones capable of cooperating with the electronic products are increasingly higher; the earphones are required to have a small size and hi-fidelity sound quality performances capable of realistically representing various sound effects. Furthermore, no matter what kind of the above-described electronic products are, in order to allow users to hear the sound signals provided by the electronic products without interfering with other people, the earphone has become an essential accessory for various electronic products. In addition, the earphone also provides a better sound transmission for the listener, so that the listener can clearly hear and understand the sound content.

The existing earphones can be divided into in-ear, on-ear and semi in-ear earphones according to wearing styles. The existing earphone mainly comprises a front housing of the earphone, a rear housing of the earphone and a loudspeaker unit (horn) accommodated within the front housing and the rear housing of the earphone. Since different earphone users have different requirements on the style of the earphone, furthermore it is also necessary to adjust the earphone into different frequency responses so as to adapt to the change of the environment for different application environments, therefore there is an urgent requiring for an earphone capable of voluntarily adjusting the frequency response of the earphone according to individual requirements so as to adapt to different users and application environments.

SUMMARY

In view of the above problems, the purpose of the present invention is to provide an earphone to resolve the current contradiction between the fact that the earphone of the same style can only present one kind of sound characteristic and the fact that the different users have different requirements on the sound quality of the earphone.

The present invention provides an earphone comprising a rear housing, a front housing adapted and coupled to the rear housing, and a loudspeaker unit accommodated in the rear housing and the front housing, and the loudspeaker unit divides the cavity defined by the rear housing and the front housing into a front acoustic cavity and a rear acoustic cavity of the earphone; wherein the earphone further comprises a sound adjusting element adapted and coupled to the front housing; wherein a sound outlet hole and mode posts are arranged on the front housing, and a sound adjusting hole corresponding to the sound outlet hole and a mode adjustment groove corresponding to the mode posts are arranged on the sound adjusting element; and the mode adjustment groove is limited by different mode posts by rotating the sound adjusting element on the front housing, so as to adjust the area of a sound hole for the front acoustic cavity and the volume of the front acoustic cavity of the earphone.

In addition, it is preferred that the sound adjusting element has a cylindrical structure, and the sound adjusting hole positioned on the sound adjusting element comprises a center sound adjusting hole and an edge sound adjusting hole positioned at the periphery of the center sound adjusting hole.

In addition, it is preferred that the center sound adjusting hole is a cylindrical through hole arranged at the center position of the sound adjusting element; and the sound adjusting hole comprises at least two pairs of the edge sound adjusting holes, and two edge sound adjusting holes of each pair are respectively symmetrical with respect to the central axis of the sound adjusting element.

In addition, it is preferred that the edge sound adjusting hole has a cross-sectional shape of a fan shape, a circular shape or a racetrack shape.

In addition, it is preferred that the front acoustic cavity is defined between the front housing and the loudspeaker unit of the earphone, and the rear acoustic cavity is defined between the rear housing and the loudspeaker unit of the earphone.

In addition, it is preferred that the mode posts have at least two groups, and the mode adjustment groove is limited by different mode posts to adjust the area of the sound hole for the front acoustic cavity and the volume of the front acoustic cavity of the earphone.

In addition, it is preferred that the loudspeaker unit comprises a unit housing, and a vibration system and a magnetic circuit system which are accommodated in the unit housing; the magnetic circuit system comprises a magnetic conductive yoke, a magnet positioned at the center position of the magnetic conductive yoke, and a washer positioned at a side of the magnet away from the magnetic conductive yoke; and the vibration system comprises a diaphragm, a voice coil fixed to one side of the diaphragm, and a reinforcing portion positioned at the center position of the diaphragm.

In addition, it is preferred that the earphone further comprises a sound filter mesh attached to the end of sound adjusting element away from the front housing.

In addition, it is preferred that the earphone further comprises an in-ear rubber sleeve covered on the end of the sound adjusting element away from the front housing.

In addition, it is preferred that the earphone further comprises an earphone wire, and one end of the earphone wire is electrically connected to the loudspeaker unit, and the other end of the earphone wire is provided with an earphone plug.

It can be seen from the above technical solutions that, in the earphone of the present invention, the sound adjusting hole arranged on the sound adjusting element extends in a sound outlet pipe structure within the sound adjusting element, when the sound adjusting hole adjacent to the front housing of the earphone is blocked, the sound outlet pipe corresponding to the sound adjusting hole is also blocked, so that the volume of the front acoustic cavity is reduced; therefore, the relative position between the sound outlet hole and the sound adjusting hole is adjusted by rotating the sound adjusting element arranged on the front housing, so as to realize the area of the sound hole of the earphone and the volume of the front acoustic cavity to be adjustable, and allow the frequency response parameters of the middle and high frequency of the earphone can be changed, to achieve the purpose of changing the sound styles of the earphone, so as to further satisfy the different requirements of different users on the sound characteristics. The present invention has the advantages of simple structure, low cost and convenient adjustment.

BRIEF DESCRIPTION OF DRAWINGS

The other purposes and results of the present invention will become more clear and easy to understand through the following descriptions in connection with the accompanying drawings and contents of claims, along with more fully understood for the present invention. In the drawings:

Figure 1:
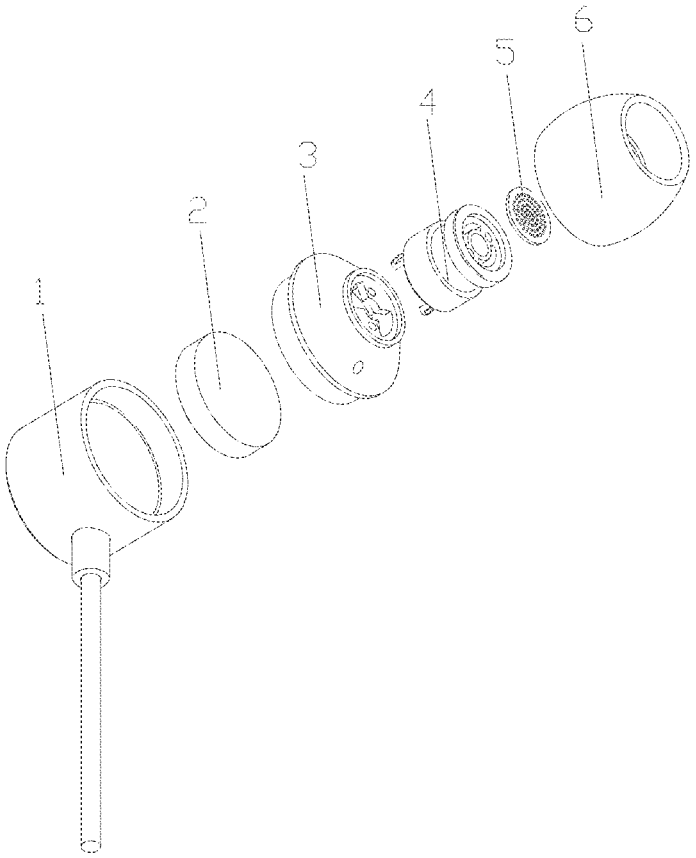
FIG. 1 is a schematic view of the exploded structure of the earphone according to an embodiment of the present invention.

Wherein, the reference numerals include: rear housing 1, loudspeaker unit 2, front housing 3, sound outlet hole 31, mode post 32, baffle 33, sound adjusting element 4, sound adjusting hole 41, center sound adjusting hole 411, edge sound adjusting hole 412, clamping claw 42, mode adjustment groove 421, sound filter mesh 5, in-ear rubber sleeve 6, the first sound hole 71, the second sound hole 72, the third sound hole 73, the fourth sound hole 74, the fifth sound hole 75.

The same reference numerals indicate similar or corresponding features or functions in all of the drawings.

DETAILED DESCRIPTION OF EMBODIMENTS

In the following description of the specific embodiments of the present invention, the sound outlet hole is a through hole arranged on the front housing of the earphone for communicating the front acoustic cavity with the sound adjusting element of the earphone; the sound adjusting hole is a through hole arranged on the sound adjusting element for adjusting the size of the final sound hole; the sound hole is a hole which finally communicating the front acoustic cavity of the earphone with the outside under the interaction of the sound outlet hole and the sound adjusting hole. In order to achieve the diversification of the sound quality of the earphone, the present invention achieves the change of the size of the final sound hole of the earphone so as to make the earphone present different music styles, by controlling the size of the sound outlet hole using the sound adjusting hole by adjusting the relative position between the sound adjusting element and the front housing.

In order to describe the structure of the earphone of the present invention in detail, the specific embodiments of the present invention will be described in detail in combination with the drawings in the following.

FIG. 1 shows an exploded structure of the earphone according to an embodiment of the present invention;

As shown in FIG. 1, the earphone of an embodiment of the present invention comprises a rear housing 1, a front housing 3 which is adapted and coupled to the rear housing 1, a loudspeaker unit 2 which is accommodated in the rear housing 1 and the front housing 3, and a sound adjusting element 4, wherein the loudspeaker unit 2 divides the cavity formed by the rear housing 1 and the front housing 3 into a front acoustic cavity and a rear acoustic cavity of the earphone; the front acoustic cavity is formed between the front housing 3 and the loudspeaker unit 2 of the earphone, and the rear acoustic cavity is formed between the rear housing 1 and the loudspeaker unit 2 of the earphone, and the sound adjusting element 4 is adapted and coupled to the front housing 3, and a plurality of sound outlet holes 31 and mode posts 32 are arranged on the front housing 3, and a sound adjusting hole 41 corresponding to the sound outlet holes 31 and a mode adjustment groove 421 corresponding to the mode posts are arranged on the sound adjusting element 4; the sound adjusting hole arranged on the sound adjusting element 4 extends in a sound outlet pipe structure within the sound adjusting element 4, when the sound adjusting hole adjacent to the front housing 3 of the earphone is blocked, the sound outlet pipe corresponding to this sound adjusting hole is also blocked, so that the volume of the front acoustic cavity is reduced, and the area of the sound hole for the front acoustic cavity of the earphone and the volume of the front acoustic cavity is adjusted by rotating the sound adjusting element 4 to limit the mode adjustment groove on different mode posts.

In one specific embodiment of the present invention, the earphone further comprises a sound filter mesh 5, an in-ear rubber sleeve 6 and an earphone wire (not shown); wherein the sound filter mesh 5 is attached to the end of sound adjusting element 4 away from the front housing 3, and can prevent the small particulate pollutants outside the earphone from entering into the interior of the loudspeaker unit 2, and also can adjust the acoustic performance of the earphone; the in-ear rubber sleeve 6 is arranged on the end of the sound adjusting element 4 away from the front housing 3, and this in-ear rubber sleeve 6 can be manufactured by utilizing materials such as silicone, highly elastic polyester, or the like, and can tightly contact with the ear canal after it is inserted into the ear canal, so as to prevent the sound from entering into the middle ear and inner ear to achieve the purpose of sound insulation. One end of the earphone wire is connected to the loudspeaker unit 2, and the other end of the earphone wire is provided with an earphone plug to use in combination with an external portable electronic product.

Specifically, the structures of the front housing, the sound adjusting element and the assembly (the sound adjusting assembly) therebetween in the earphone provided by the present invention will be described in detail in combination with the specific embodiments in the following.

Figure 2:
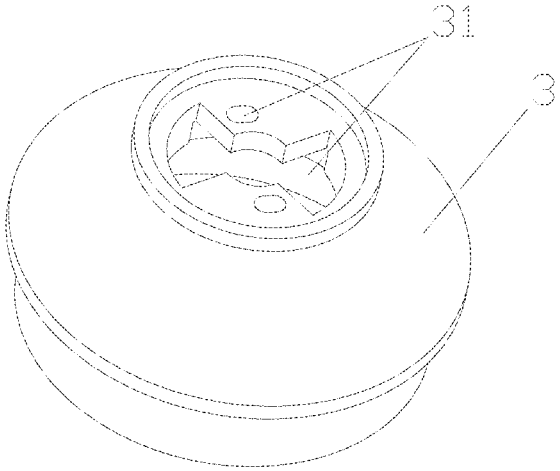
FIG. 2 is a schematic view of the structure of the front housing according to an embodiment of the present invention.
Figure 3:
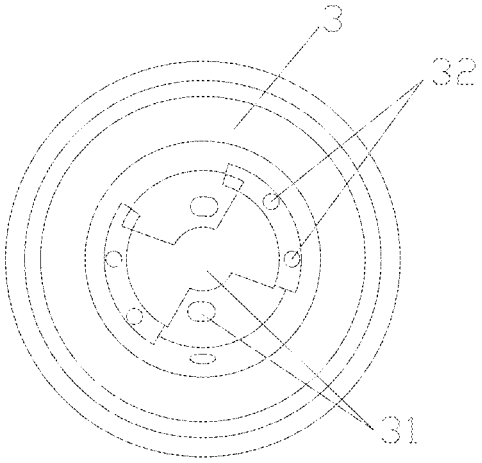
FIG. 3 is a top view of the structure of the front housing according to an embodiment of the present invention.

FIG. 2 shows the structure of the front housing according to an embodiment of the present invention; FIG. 3 shows a top view of the structure of the front housing according to an embodiment of the present invention.

As shown in FIG. 2 and FIG. 3, the front housing 3 of the embodiment of the present invention is approximately a truncated cone structure and comprises mode posts 32 and a plurality of sound outlet holes 31 with different shapes; wherein the sound outlet holes 31 are arranged on the end of the front housing 3 away from the rear housing 1, and an arc-shaped protrusion is arranged below the sound outlet holes 31, and the mode posts 32 are arranged on the arc-shaped protrusion and is used in combination with the mode adjustment groove on the sound adjusting element which will be described later.

Wherein, in order to make the force applied between the sound adjusting element and the front housing 3 to be even when the sound adjusting element rotates on the front housing 3, the mode posts 32 are arranged in pairs. During assembly of the earphone, the mode adjustment groove is positioned at a group of two symmetrically arranged mode posts 32, and the mode adjustment groove flexibly switches between groups of mode posts by manually rotating the sound adjusting element, wherein, the number and shape of the sound outlet holes positioned on the front housing 3 and the number of pairs of the mode posts can be set voluntarily.

Figure 4:
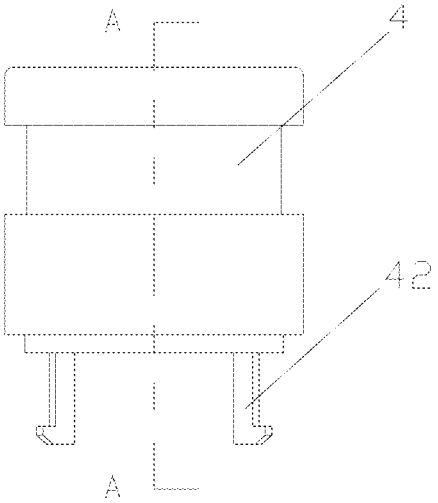
FIG. 4 is a schematic view of the structure of the sound adjusting element according to an embodiment of the present invention.
Figure 5:
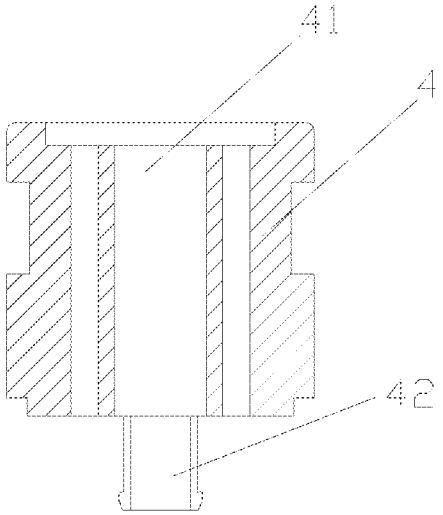
FIG. 5 is a sectional view taken along A-A line of FIG. 4.
Figure 6:
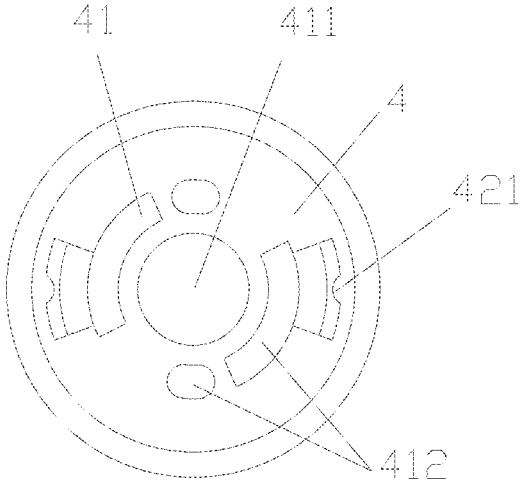
FIG. 6 is a top view of the structure of the sound adjusting element according to an embodiment of the present invention.

FIG. 4 shows the structure of the sound adjusting element according to an embodiment of the present invention; FIG. 5 is a sectional structure taken along A-A line of FIG. 4; FIG. 6 shows a top view of the structure of the sound adjusting element according to an embodiment of the present invention.

As shown in FIG. 4 to FIG. 6 together, the sound adjusting element 4 in the embodiment of the present invention has a cylindrical structure and comprises a plurality of sound adjusting holes 41 penetrating through the entire of the sound adjusting element 4, a clamping claw 42 extending from the interior of the sound adjusting element 4, and a mode adjustment groove 421 positioned at one end of the clamping claw 42.

Wherein, corresponding to the sound outlet holes 31 on the front housing 3, the sound adjusting holes 41 arranged on the sound adjusting element 4 comprises a center sound adjusting hole 411 positioned at the center position of the sound adjusting element 4, and edge sound adjusting holes 412 positioned at the periphery of the center sound adjusting hole 411; preferably, the center sound adjusting hole 411 is a cylindrical through hole arranged in the center of the sound adjusting element 4, and the edge sound adjusting holes 412 have at least two pairs, and two edge sound adjusting holes 412 of each pair are respectively symmetrical with respect to the central axis of the sound adjusting element 4, thus it can be know that, the edge sound adjusting holes 412 also can be arranged into one pair which symmetrical with respect to the central axis of the sound adjusting element 4. In this case, the areas of the two edge sound adjusting holes 412 can be set larger accordingly to prevent the sound adjusting element 4 from completely blocking the sound outlet hole 31 on the front housing 3. The cross-sectional shape of the edge sound adjusting hole 412 can be various shapes such as a fan shape, a circular shape or a racetrack shape, and the edge sound adjusting hole 412 can correspond to the sound outlet hole 31 on the front housing 3, and can deviate from the sound outlet hole 31 when the sound adjusting element 4 is rotated, to change the volume of the front acoustic cavity of the earphone and the area of the sound hole communicating the front acoustic cavity with the outside.

In a specific embodiment of the present invention, a pair of clamping claws 42 are provide, and are symmetrically distributed with respect to the central axis of the sound adjusting element 4 respectively. Arc-shaped recesses for matching with the position posts 32 are arranged at the lower portions of the clamping claws 42, and the arc-shaped recess is the mode adjustment groove 421. When the mode adjustment grooves 421 are rotated to different mode posts 32, the relative position between the sound adjusting hole 41 and the sound outlet hole 31 will change, so that the area of the sound hole communicating the front acoustic cavity of the earphone with the outside, and the volume of the front acoustic cavity will change.

Figure 7:
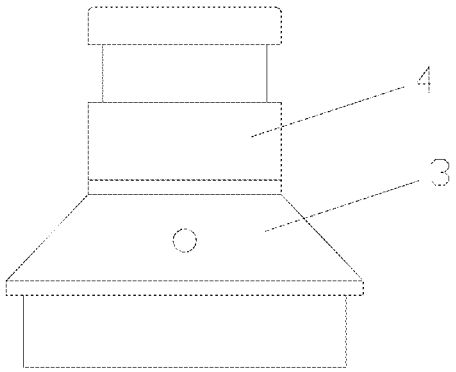
FIG. 7 is a schematic view of the structure of the sound adjusting assembly according to an embodiment of the present invention.
Figure 8:
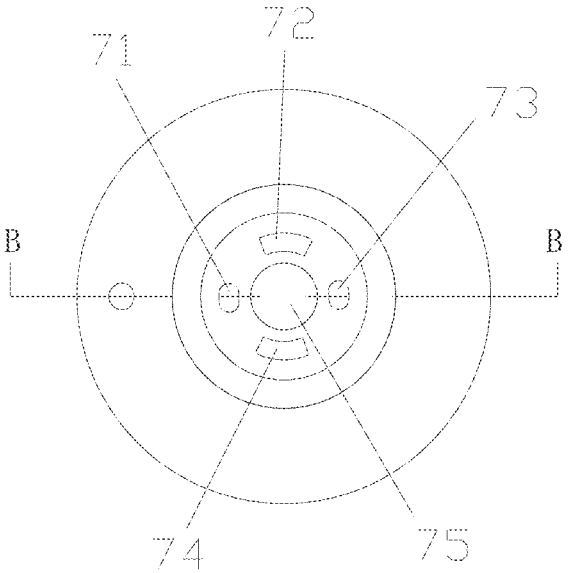
FIG. 8 is a one top view of the sound adjusting assembly according to an embodiment of the present invention.
Figure 9:
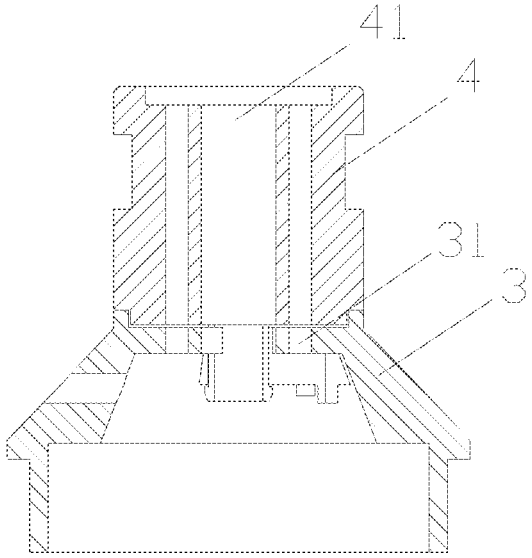
FIG. 9 is a sectional view taken along B-B line of FIG. 8.

FIG. 7 shows a sound adjusting assembly structure according to an embodiment of the present invention; FIG. 8 shows a top view of the structure of one state of the sound adjusting assembly according to an embodiment of the present invention; FIG. 9 is a sectional structure taken along B-B line of FIG. 8.

As shown commonly in FIG. 7 to FIG. 9, the sound adjusting assembly of the embodiment of the present invention comprises a front housing 3 and a sound adjusting element 4, and the front housing 3 and the sound adjusting element 4 are fixed by a snap or a screw thread connection, and the region between the sound adjusting hole 41 positioned on the sound adjusting element 4 and the sound outlet hole 31 positioned on the front housing 3 is partially communicated or blocked.

In the embodiment of the present invention, the mode adjustment groove 421 of the sound adjusting element 4 is limited by the five-hole mode posts 32 of the front housing 3 (i.e. when the mode adjustment groove 421 is limited by the pair of mode posts 32, there are five sound holes in communicate with the outside). At this moment, the shielded area between the sound adjusting hole 41 positioned on the sound adjusting element 4 and the sound outlet hole 31 positioned on the front housing 3 is minimum, i e all of the sound holes (including the first sound hole 71, the second sound hole 72, the third sound hole 73, the fourth sound hole 74 and the fifth sound hole 75) of the earphone formed between the sound outlet hole 31 and the sound adjusting hole 41 are in communication with the outside, and the area of the sound holes of the earphone is the sum of the area of the five sound holes, and the volume of the front acoustic cavity is the sum of the cavity volume between the loudspeaker unit and the front housing 3 with the cavity volume of the interior of the sound adjusting element 4. In other words, when the mode adjustment groove 421 of the sound adjusting element 4 is limited by the proper mode posts 32 (five-hole mode posts) of the front housing 3, both the area of the sound hole of the earphone and the volume of the front acoustic cavity can reach the maximum, so that the earphone presents one sound quality.

During the rotation of the sound adjusting element 4, the mode adjustment grooves 421 of the sound adjusting element 4 are switched between the mode posts 32 of the front housing 3, and the area of the sound hole and the volume of the front acoustic cavity of the earphone also change accordingly.

Figure 10:
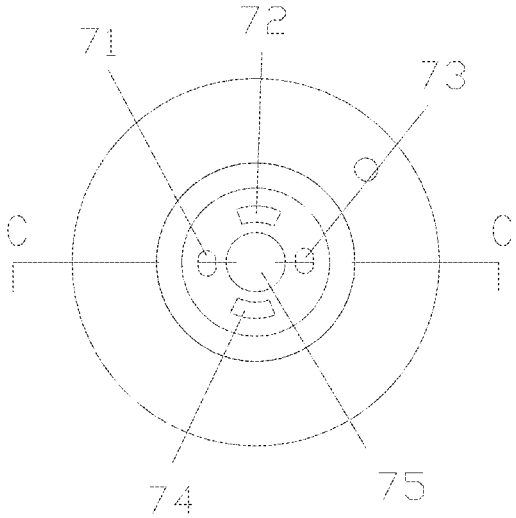
FIG. 10 is an another top view of the sound adjusting assembly according to an embodiment of the present invention.
Figure 11:
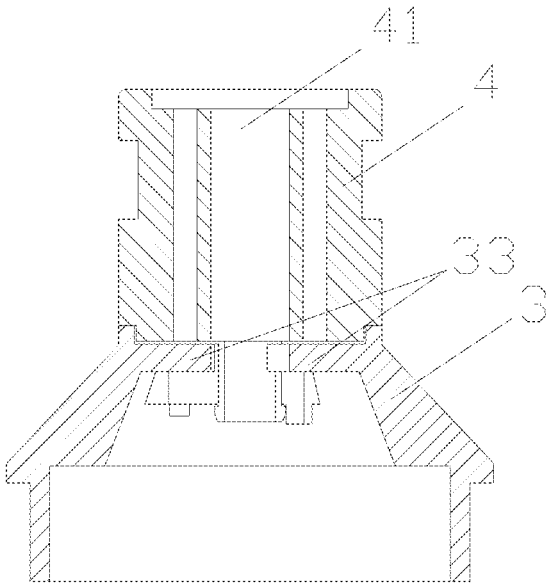
FIG. 11 is a sectional view taken along C-C line of FIG. 10.

FIG. 10 shows a top view of the structure of another state of the sound adjusting assembly according to an embodiment of the present invention; and FIG. 11 shows a sectional structure taken along C-C line of FIG. 10.

As shown in FIG. 10 and FIG. 11 together, the sound adjusting element 4 rotates on the basis of the structure shown in FIG. 7 to FIG. 9. At the moment, the mode adjustment groove 421 of the sound adjusting element 4 is limited by the three-hole mode posts 32 of the front housing (i.e. when the mode adjustment groove 421 is limited by the pair of mode posts 32, there are three sound holes in communicate with the outside), the sound adjusting hole 41 positioned on the sound adjusting element 4 is partially shielded by the baffle 33 (i.e. a non-sound outlet hole portion of the front housing) of the front housing.

In the embodiment of the present invention, the mode adjustment groove 421 of the sound adjusting element 4 is limited by the three-hole mode posts 32 of the front housing.

At this moment, the sound adjusting holes 41 positioned on the sound adjusting element block two sound outlet holes having a cross-section of racetrack shape and positioned on the front housing, at this moment, the area of the sound hole communicating the front acoustic cavity of the earphone with the outside becomes smaller, and the volume of the front acoustic cavity also becomes smaller. In other words, in the sound hole of the earphone formed between the sound outlet hole and the sound adjusting hole 41, the first sound hole 71 and the third sound hole 73 are shielded by the baffle 33 of the front housing, and the total area of the sound hole is the sum of the area of the second sound hole 72, the fourth sound hole 74 and the fifth sound hole 75, and the middle and high frequency responses of the earphone change accordingly, so as to enable the earphone to present different music styles.

Figure 12:
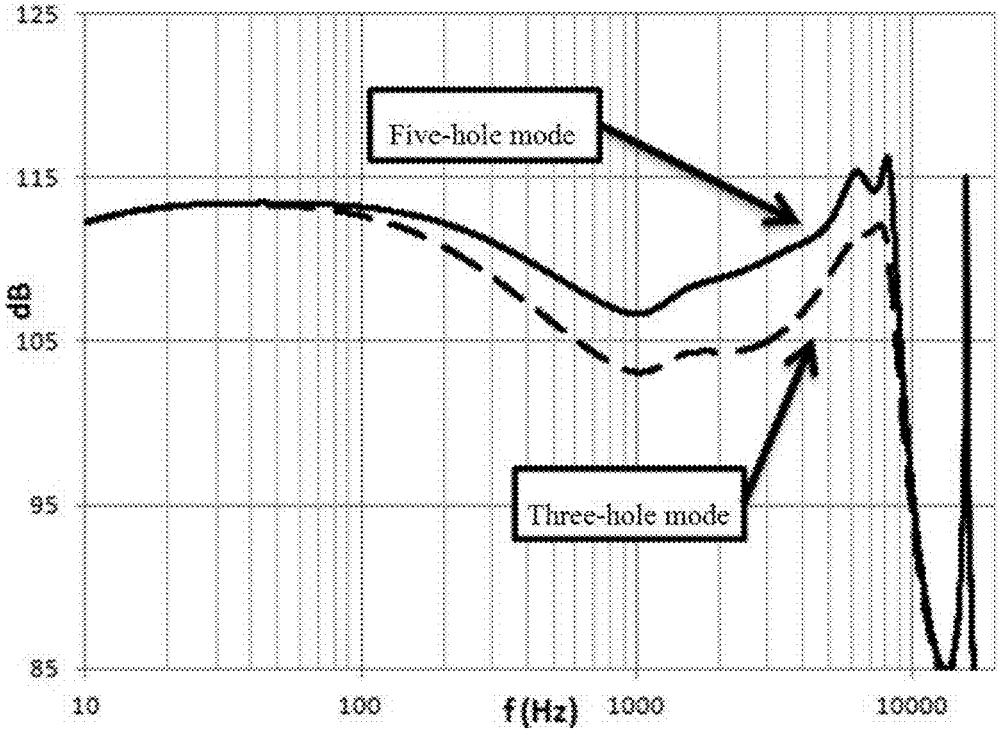
FIG. 12 is a graph of the frequency response of the earphone according to an embodiment of the present invention.

For the frequency responses when the above mode adjustment groove 421 positioned at the three-hole mode and the five-hole mode, FIG. 12 shows a comparison result of the frequency response curves of the earphone according to the embodiment of the present invention.

As shown in FIG. 12, the horizontal axis represents the frequency (unit: Hertz, i.e., Hz) and the vertical axis represents the frequency response (unit: decibel, i.e., dB). The solid line represents the earphone frequency response curve when the mode adjustment groove 421 of the sound adjusting element 4 is rotated to the five-hole mode, and the dotted line represents the earphone frequency response curve when the mode adjustment groove 421 of the sound adjusting element 4 is rotated to the three-hole mode. It can be known that, when the mode adjustment groove 421 is positioned at different mode posts, i.e., the volume of the front acoustic cavity and the area of the sound hole of the earphone change, the middle and high frequency responses of the earphone will obviously change. Furthermore, when the volume of the front acoustic cavity and the area of the sound hole of the earphone are large, the frequency response curve of the earphone at the middle frequency or the high frequency is obviously higher than the frequency response curve when the volume of the front acoustic cavity and the area of the sound hole are small. Therefore, the area of the sound hole of the earphone and the volume of the front acoustic cavity may be changed by rotating the sound adjusting element, such that the middle and high frequency responses of the earphone are changed, so as to achieve the purpose of changing the sound style of the earphone.

In addition, in one specific embodiment of the present invention, the loudspeaker unit comprises a unit housing, and a vibration system and a magnetic circuit system which are accommodated in the unit housing, and the magnetic circuit system comprises a magnetic conductive yoke for fixing the magnet and correcting the magnetic field lines, a magnet arranged at the center position of the magnetic conductive yoke, and a washer positioned at a side of the magnet away from the magnetic conductive yoke; wherein, a magnetic gap is formed between the magnet along with the washer and the side wall of the magnetic conductive yoke, and a voice coil is suspended in the magnetic gap. The magnetic conductive yoke is fixed on the unit housing, and the vibration system, the magnet and the washer are accommodated in the cavity formed by the magnetic conductive yoke and the unit housing, and the washer, the magnet and the magnetic conductive yoke are fixed from top to bottom in sequence.

The vibration system comprises a diaphragm, a voice coil fixed to one side of the diaphragm, and a reinforcing portion positioned at the center position of the diaphragm. Wherein, the diaphragm comprises a fixing portion (positioned at the outermost periphery of the diaphragm) fixedly connected with the unit housing, a suspension ring portion of the concave/convex structure which is integrated with the fixing portion, and a plane portion (positioned at the innermost part of the diaphragm) arranged inside the suspension ring portion. The reinforcing portion is arranged on the plane portion of the diaphragm and mainly used for adjusting the acoustic performance of the loudspeaker. In order to reduce the overall weight of the vibration system, generally, a part of the plane portion of the diaphragm at a position corresponding to the reinforcing portion is removed, and the reinforcing portion covers the position of the removed part.

It should be noted that, the sound outlet hole, the sound adjusting hole, the mode post and the mode adjustment groove of the embodiment of the present invention can be set and adjusted accordingly according to production requirements and user requirements. For example, increasing the number of sound adjusting holes or changing the cross-sectional shapes of the sound outlet hole and the sound adjusting hole, so as to increase the adjusting ranges of the area of the sound hole of the earphone and the volume of the front acoustic cavity; or increasing the number of the mode posts and the number of the corresponding mode adjustment grooves, so as to enable the earphone to switch between a plurality of modes to increase the music styles of the earphone, such as setting one-hole mode, two-hole mode, four-hole mode and the like.

It can be seen from the above embodiments that, by rotating the sound adjusting element to different adjustment modes, the earphone provided by the present invention can change the area of the sound hole of the earphone and the volume of the front acoustic cavity of the earphone and can change the frequency responses of the middle frequency and the high frequency of the earphone, so as to enable the earphone to present different music styles to satisfy the requirements of different users; in addition, the earphone provided by the present invention also can increase the types of the music style of the earphone and achieve a simple structure and easy adjustment by setting a plurality of adjustment modes.

The earphone according to the present invention has been described by way of example with reference to the drawings. However, those skilled in the art should understand that various improvements can be made on the earphone proposed in the present invention as described above without departing from the content of the present invention. Therefore, the protection scope of the present invention should be determined by the contents of the appended claims.

The invention claimed is:

1. An earphone, comprising a rear housing, a front housing adapted and coupled to the rear housing, and a loudspeaker unit accommodated in the rear housing and the front housing, wherein the loudspeaker unit divides a cavity defined by the rear housing and the front housing into a front acoustic cavity and a rear acoustic cavity of the earphone, wherein the earphone further comprises a sound adjusting element adapted and coupled to the front housing, wherein a sound outlet hole and mode posts are defined on the front housing, and a sound adjusting hole corresponding to the sound outlet hole and a mode adjustment groove corresponding to the mode posts are defined on the sound adjusting element; and the mode adjustment groove is rotatable by rotating the sound adjusting element on the front housing and is limited by different mode posts, so as to adjust an area of a sound hole for the front acoustic cavity and a volume of the front acoustic cavity of the earphone.

2. The earphone according to claim 1, wherein the sound adjusting element has a cylindrical structure, and the sound adjusting hole positioned on the sound adjusting element comprises a center sound adjusting hole and an edge sound adjusting hole positioned at a periphery of the center sound adjusting hole.

3. The earphone according to claim 2, wherein the center sound adjusting hole is a cylindrical through hole arranged at a center position of the sound adjusting element; and the sound adjusting hole comprises at least two pairs of the edge sound adjusting holes, and two edge sound adjusting holes of each pair are respectively symmetrical with respect to a central axis of the sound adjusting element.

4. The earphone according to claim 3, wherein the edge sound adjusting hole has a cross-sectional shape of a fan shape, a circular shape or a racetrack shape.

5. The earphone according to claim 3, wherein the front acoustic cavity is defined between the front housing and the loudspeaker unit of the earphone, and the rear acoustic cavity is defined between the rear housing and the loudspeaker unit of the earphone.

6. The earphone according to claim 5, wherein the mode posts have at least two groups, and the mode adjustment groove is limited by different mode posts to adjust the area of the sound hole for the front acoustic cavity and the volume of the front acoustic cavity of the earphone.

7. The earphone according to claim 6, wherein the mode posts are arranged in pairs, and the mode adjustment groove is positioned at a group of two symmetrically arranged mode posts.

8. The earphone according to claim 1, wherein the loudspeaker unit comprises a unit housing, and a vibration system and a magnetic circuit system which are accommodated in the unit housing;

the magnetic circuit system comprises a magnetic conductive yoke, a magnet positioned at a center position of the magnetic conductive yoke, and a washer positioned at a side of the magnet away from the magnetic conductive yoke; and the vibration system comprises a diaphragm, a voice coil fixed to one side of the diaphragm, and a reinforcing portion positioned at a center position of the diaphragm.

9. The earphone according to claim 1, further comprising a sound filter mesh, wherein the sound filter mesh is attached to an end of sound adjusting element away from the front housing.

10. The earphone according to claim 1, further comprising an in-ear rubber sleeve, wherein the in-ear rubber sleeve is covered on an end of the sound adjusting element away from the front housing.

11. The earphone according to claim 1, further comprising an earphone wire, wherein one end of the earphone wire is electrically connected to the loudspeaker unit, and another end of the earphone wire is provided with an earphone plug.

12. The earphone according to claim 1, wherein the sound adjusting hole extends in a sound outlet pipe structure within the sound adjusting element, and when the sound adjusting hole adjacent to the front housing is blocked, the sound outlet pipe corresponding to the sound adjusting hole is also blocked, so that the volume of the front acoustic cavity is reduced.

13. The earphone according to claim 1, wherein the front housing is a truncated cone structure, and the sound outlet hole comprises a plurality of sound outlet holes with different shapes, and wherein the sound outlet holes are arranged on one end of the front housing away from the rear housing, an arc-shaped protrusion is arranged below the sound outlet holes, and the mode posts are arranged on the arc-shaped protrusion.

14. The earphone according to claim 1, wherein the sound adjusting element further comprises a clamping claw extending from the interior of the sound adjusting element, and the mode adjustment groove is positioned at one end of the clamping claw.

15. The earphone according to claim 14, wherein the clamping claw comprises a pair of clamping claws which are symmetrically distributed with respect to a central axis of the sound adjusting element, the mode adjustment groove is an arc-shaped recess.

16. The earphone according to claim 1, wherein the front housing and the sound adjusting element are fixed by a snap or a screw thread connection, and a region between the sound adjusting hole and the sound outlet hole is partially communicated or blocked.

* * * * *